United States Patent [19]

Cyphelly

[11] 4,265,267

[45] May 5, 1981

[54] FLOW CONTROL DEVICE FOR USE WITH POSITIVE DISPLACEMENT PUMP

[76] Inventor: Ivan J. Cyphelly, Neuhaus, 8128-Hinteregg, Switzerland

[21] Appl. No.: 935,913

[22] Filed: Aug. 23, 1978

Related U.S. Application Data

[63] Continuation-in-part of Ser. No. 762,570, Jan. 26, 1977, Pat. No. 4,164,240.

[30] Foreign Application Priority Data

| | | | |
|---|---|---|---|
| Aug. 25, 1977 | [CH] | Switzerland | 10402/77 |
| Jan. 25, 1978 | [CH] | Switzerland | 811/78 |
| Jan. 25, 1978 | [CH] | Switzerland | 812/78 |

[51] Int. Cl.[3] ..... F16K 5/00; F16K 15/00; F16K 17/38

[52] U.S. Cl. ..... 137/117; 137/468; 137/512.1; 137/543.15; 137/624.15; 137/887; 137/565.1; 251/333; 417/442

[58] Field of Search ..... 137/624.15, 887, 117, 137/543.15, 568, 565.1, 512.1; 417/442, 502, 504; 251/333

[56] References Cited

U.S. PATENT DOCUMENTS

| | | | |
|---|---|---|---|
| 687,041 | 11/1901 | Logan | 137/625.32 |
| 1,808,209 | 6/1931 | Earl | 137/568 |
| 1,990,263 | 2/1935 | Benedek | 417/506 |
| 2,016,503 | 10/1935 | Kenworthy | 417/442 |
| 2,649,273 | 8/1953 | Honegger | 251/333 |
| 2,704,035 | 3/1955 | Bader | 417/504 |
| 2,725,076 | 11/1955 | Hansen et al. | 137/543.15 |
| 2,980,173 | 4/1961 | Perkey | 137/117 |
| 3,152,603 | 10/1964 | Zeisloft | 137/117 |
| 3,316,846 | 5/1967 | Bender | 137/624.15 |
| 3,532,106 | 10/1970 | Greure | 137/117 |
| 3,788,351 | 1/1974 | Conklin, Jr. | 137/512.1 |
| 3,919,923 | 11/1975 | Haigh | 137/82 |
| 4,164,240 | 8/1979 | Cyphelly | 137/468 X |
| 4,188,144 | 2/1980 | Peters et al. | 137/499 |

FOREIGN PATENT DOCUMENTS

| | | | |
|---|---|---|---|
| 2519366 | 1/1976 | Fed. Rep. of Germany . | |
| 655560 | 7/1951 | United Kingdom | 137/543.15 |

*Primary Examiner*—Alan Cohan
*Assistant Examiner*—A. Michael Chambers
*Attorney, Agent, or Firm*—Browdy & Neimark

[57] ABSTRACT

To control the flow of fluid from a positive displacement pump to a consumer line, a rotating shutter periodically opens return flow nozzles which permit the pressure-free return of the pumped fluid to a fluid reservoir. In order to provide hydraulic balancing of the forces on the shutter, the return flow nozzles are disposed symmetrically with respect to the axis of the rotating shutter. Pressure peaks which occur when the return flow nozzles are closed cause undesirable noise generation and these pressure peaks are reduced by the disposition of separate check valves associated with each of the symmetric flow conduits. The use of separate check valves reduces the length of the fluid column which must be accelerated upon nozzle closure. To reduce the opening stroke of the check valve, the edge of the valve seat meanders thereby extending its effective length. Axial play of the rotating shutter is controlled by the disposition of a spring loaded glide block.

13 Claims, 3 Drawing Figures

1
9
15
24
16
31
21
39
8
3
4
13
22
17
38
23
34
33
32
36
35
37
27

FLOW CONTROL DEVICE FOR USE WITH POSITIVE DISPLACEMENT PUMP

CROSS REFERENCE TO RELATED APPLICATION

This application is a continuation-in-part of applicants' co-pending application Ser. No. 762,570 filed Jan. 26, 1977, now U.S. Pat. No. 4,164,240, the entire contents of which are hereby incorporated by reference.

FIELD OF THE INVENTION

The present invention relates to a device for use in association with a positive displacement pump for the purpose of controlling the volume of flow or the flow pressure by periodic interruption of the flow to the output side load and directing that flow into a zero pressure reservoir. More particularly, the invention relates to a device in which the interrupting means is a rotary shutter which opens and closes the line leading to the zero-pressure reservoir as the shutter rotates.

BACKGROUND OF THE INVENTION

A device for regulating the volume rate of delivery of flow from a positive displacement pump is known from Swiss Pat. No. 594,137 and U.S. Pat. No. 4,164,240. In the device described there, the rotary shutter has a pair of raised ribs or cam lobes which alternately open and close two oppositely disposed nozzles. When opened, the two nozzles permit communication with a zero-pressure reservoir, and thus temporarily interrupt the supply of fluid to the output side. When the return flow nozzles are closed, however, the fluid in the pump is forced to flow through a single non-return or check valve to the output connection of the device. The edges of the rotary shutter are angled so as to permit material removal of the terminal of the return flow nozzles so as to generate during the initial operation an optimum gap as between the rotary shutter and the return flow nozzles.

When the openings of the return flow nozzles in the known device are round, which is preferable for reasons of simplified manufacture, the sound level which is generated by the device in operation is no less than 80 dB (A). This sound level is produced by the transformation of pressure peaks in the lines and the conduits of the pump into an acoustical signal.

SUMMARY OF THE INVENTION

Accordingly, it is an object of the present invention to provide a device of the type described in the prior art and more particularly in Swiss Pat. No. 594,137 and the associated U.S. Pat. No. 4,164,240 in which the level of sound which is generated in operation is reduced without thereby reducing the efficiency or varying the volume of flow through the device.

In accordance with the present invention, this is achieved by providing means which reduce the linear motions of parts of the device which are exposed to the flow.

More specifically, the elements of the device which are exposed to the flow and which tend to execute linear motions and thus produce undesirable sound under the influence of the pressure pulses that are generated when the rotary shutter opens and closes the return flow nozzles are, firstly, the rotary shutter itself moving in its axial bearing, as well as the fluid column adjacent to the non-return valve. According to the present invention, the linear motion i.e. the motion in the direction of fluid flow of the fluid column adjacent to the non-return valve is reduced which results in simple yet effective reduction of sound emission without thereby impeding the normal functioning of the device.

In a first preferred embodiment of the present invention, the means for reducing the motions of internal elements of the device consist of providing a separate non-return valve connected to the consumer or output line in association with each of the return flow nozzles. In this manner, the length of the fluid columns which must be accelerated and decelerated when the flow is switched by the rotating shutter is reduced.

It is a feature of the present invention that the non-return or check valves are contained in the nozzle blocks which include the return flow nozzles. It is a further feature of the present invention that the internal conduits of the pump are so located that the fluid flow enters the region between the termini of the return flow nozzles and the location of the check valves within the bores containing the return flow nozzles.

In a second embodiment of the present invention, the means for reducing the motions of internal parts of the device consist of providing a meandering or labyrinth check valve seat so as to reduce the opening stroke of the valve required to permit full fluid flow therethrough.

By the foregoing embodiment, which reduces the valve stroke of the check valve compared with a check valve having a normally round valve seat, the pressure peaks occurring during the flow diversion are reduced and thus the sound level is also diminished.

In a third embodiment of the means for reducing motions of internal parts of the device, which may be associated to either one of the first named embodiments, the axial position of the rotary shutter is defined in an axial bearing which is urged against a non-rotating but axially adjustable mechanism by a co-rotating spring located within the hollow shaft of the rotating shutter.

It is a particular feature of the last named embodiment that the axial force peaks, which are produced by the residual pressure peaks in the known device according to the U.S. Pat. No. 4,164,240 which cause small axial motions of the rotary shutter within a roller bearing and which thus produce undesirable sound levels, are substantially prevented. Inasmuch as the entire length of the drive shaft is available for housing the spring which produces the axial alignment of the rotary shutter, the spring may be as long as necessary to make its effective force independent of the particular axial position of the rotary shutter. For this reason, any disturbing effect on very sensitive adjustment mechanisms, such as current or pressure control mechanisms, is held to very low levels.

BRIEF DESCRIPTION OF THE DRAWINGS

The following is a further explanation of three embodiments of the subject of the present invention with reference to the drawings in which.

BRIEF DESCRIPTION OF THE PREFERRED EMBODIMENTS

Figure 1:
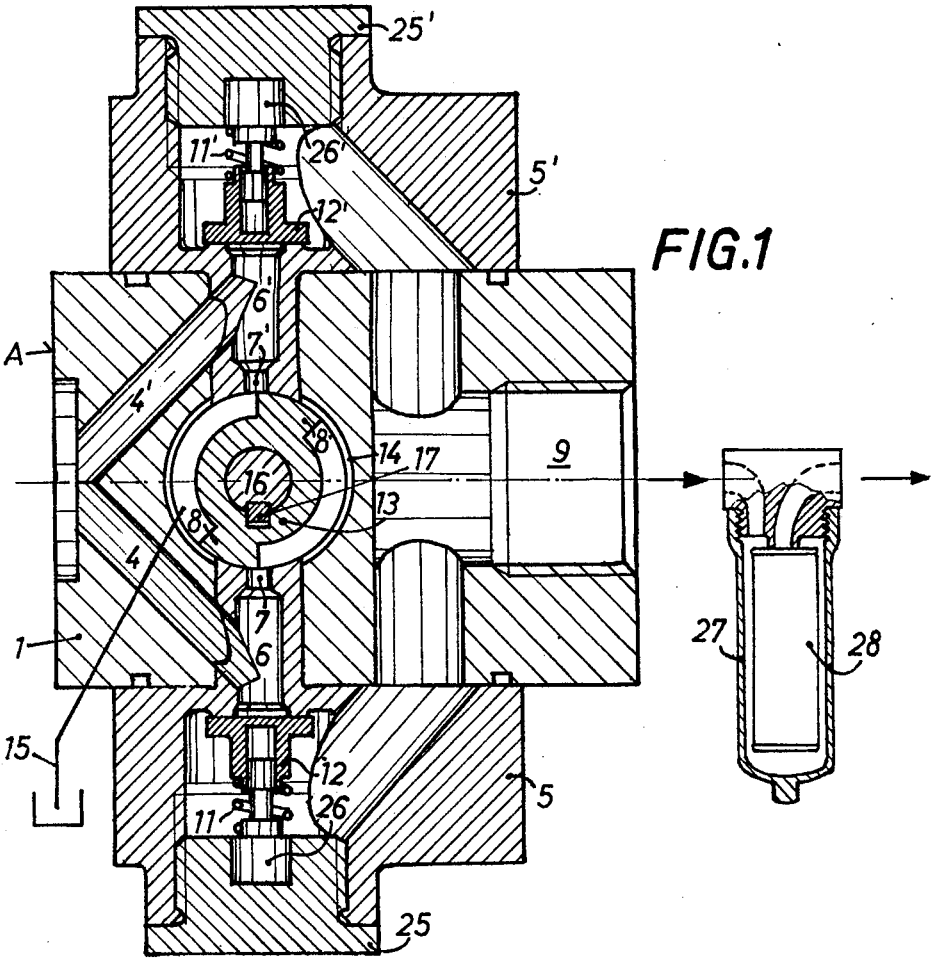
FIG. 1 is a cross-section through the device according to the invention at right angles to the drive shaft of the rotary shutter.

FIG. 1 is an illustration which substantially corresponds to FIG. 1 of the Swiss Pat. No. 594,137 and U.S. Pat. No. 4,164,240. This figure illustrates a valve housing 1 for attachment by bolts (not shown) to a positive displacement pump (not shown) on a surface.

The fluid issuing from the pump under pressure flows through connecting bores 4, 4' in the valve housing, respectively terminating in bores 6, 6', each of which is defined within a respective nozzle shaft which is an extension of respective nozzle blocks 5, 5'. The nozzles 6,6' have nozzle orifices 7, 7' which can be obturated by shutter blades 8,8' which are integral with a rotating shutter 13 mounted coaxially on a drive shaft 16 and held there co-rotatingly by a key 17. It will be appreciated that, when the nozzle orifices 7,7' are closed by the shutter blades 8,8', the pressurized fluid is forced to flow to the consumer outlet 9 via check valves 12, 12' located, respectively, in the nozzle blocks 5, 5'. Each of the check valves is loaded in the closure mode by a spring 11, 11' and is centered in its respective location by guide pins 26, 26' respectively associated with covers 25, 25'. If the nozzle orifices 7, 7' are open, however, the fluid is permitted to enter the hollow volume defined between the shutter bushing 13 and a bore 14 within the valve housing from which it may flow at zero pressure through a line 15 to a fluid reservoir. It will be appreciated that the length of the fluid columns to be accelerated when the orifices 7, 7' are closed is limited to the volume of the bore 6, 6' defined between the termini of the bores 4, 4' and the check valves 12, 12' located within the nozzle blocks 5, 5'. The fluid column which must be accelerated when the orifices 7, 7' are opened, is defined by the volume of the bores 6, 6' as between the termini of the bores 4, 4' and the return flow orifices 7, 7'.

The masses to be accelerated are thus substantially smaller than in the device of the prior art, so that, even when the return flow nozzle openings do not have the most favorable shape, the pressure peaks occurring during fluid flow changes are substantially reduced, so that any remaining pulsation may be completely absorbed, for example, by a thin-walled vial 27 of a high-pressure filter 28 connected to the consumer outlet 9 of the device.

The rotary drive power for the shutter bushing 13 may be similar or identical with that described in U.S. Pat. No. 4,164,240 and will not be discussed further.

Figure 2:
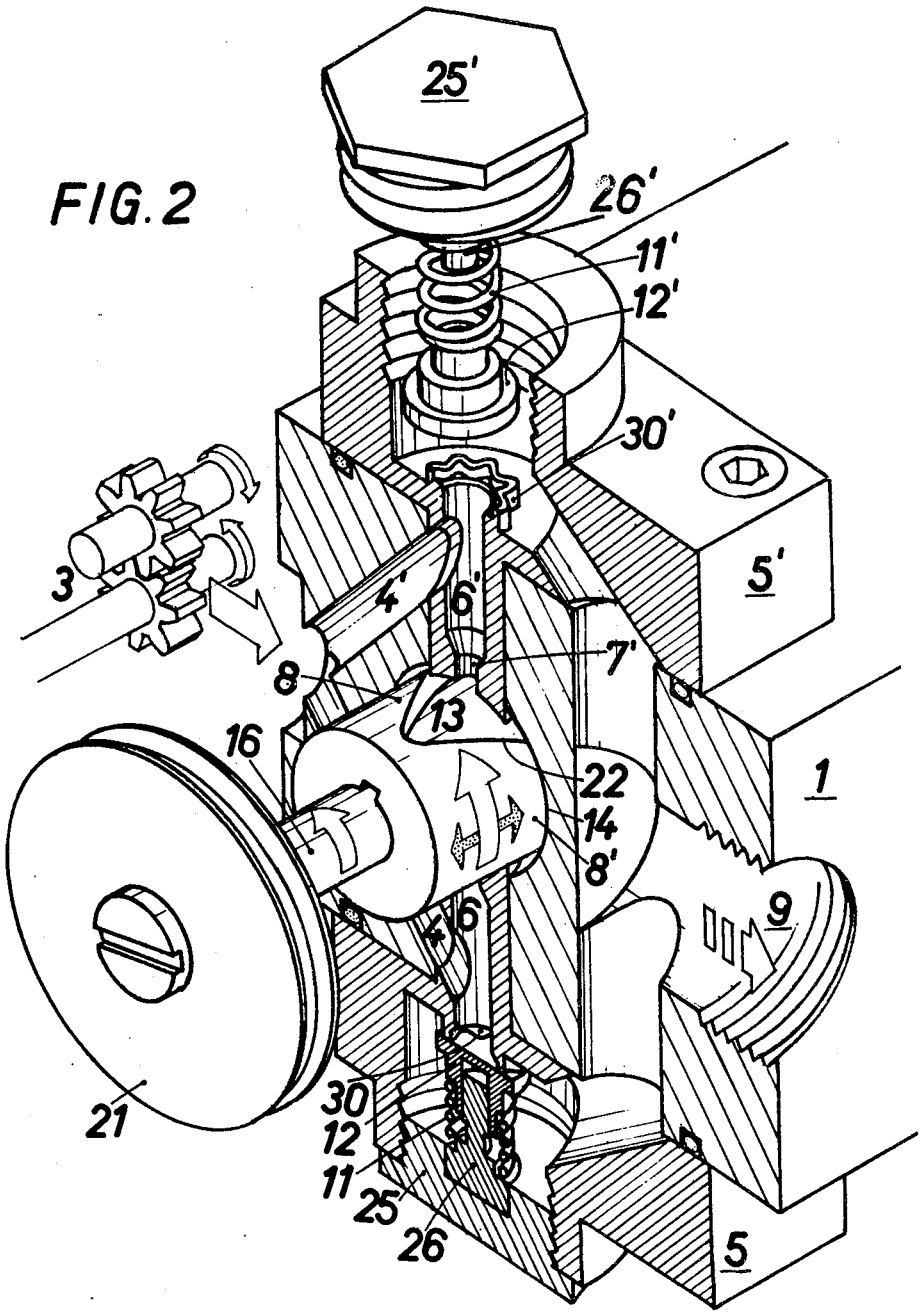
FIG. 2 is an axonometric section through the return flow nozzles of the device according to the invention, illustrating separate and independent check valves with meandering valve seats.

The construction and operation of the device according to the present invention may be further understood from the illustration of FIG. 2 where the valve housing 1 is shown to be coupled by suitable means to a positive displacement gear pump 3. The fluid stream indicated schematically by an arrow flows through the bores 4, 4' directly into the bores 6 and 6' associated, respectively, with the nozzle extension of the nozzle blocks 5, 5'. As discussed in connection with FIG. 1, when the edges 22 of which only one is visible in FIG. 2 close the orifices 7, 7' of the nozzles 6, 6', the fluid flow is forced to travel to the consumer outlet 9 via the check valves 12 and 12', respectively disposed within the nozzle blocks 5, 5'. When the orifices 7, 7' are open, the fluid may flow into the hollow space defined between the shutter bushing 13 and a bore 14 whence it flows via the line 15 (not shown) to a zero-pressure reservoir (not shown).

The rotary shutter bushing 13 is mounted on a power drive shaft 16 in a manner permitting relative axial displacement thereon but forced to co-rotate therewith, as indicated schematically by the arrows.

It is a requirement of operation of the present device that, when the shutter edges 22 close the nozzle orifices 7, 7', the check valves 12, 12' which had been urged closed by the springs 11, 11' must open immediately.

However, the increased pressure required to accelerate the stationary fluid columns and to open the check valves 12, 12' until the full flow opening is obtained, constitutes part of the flow switching pressure peak and it is this peak which has to be kept at relatively low levels because of the inherent noise generation which it is an object of the invention to prevent. The increased pressure could be reduced in principle by diminishing the mass of the check valves 12, 12' but such a reduction of mass is not possible in practice because of hydraulic and mechanical requirements.

According to the present invention, the pressure increase required to open the check valves 12, 12' is reduced by providing a meandering or labyrinth-like valve seat 30, 30' for the check valves 12, 12', as illustrated best in FIG. 2. The valve seats 30, 30' are located at the extreme ends of the bores 6, 6' of the two nozzle extensions. The labyrinth-like shape of the valve seats 30, 30' is a simple means for extending the effective length of the valve seat while diminishing its width so that the effective axial stroke of the closure element within the check valves required to obtain a fully opened valve is reduced. This reduction also diminishes the pressure peaks occurring during the switching of flows and thus reduces the generation of objectionable noise.

The aforementioned labyrinth-like construction of the valve seat of the check valve can also be provided in the single check valve contained in the device described in U.S. Pat. No. 4,164,240. However, the provision of separate check valves, respectively associated with each of the two return flow nozzles, results in a reduction of the accelerated masses of fluid and thus further reduces the sound levels.

Figure 3:
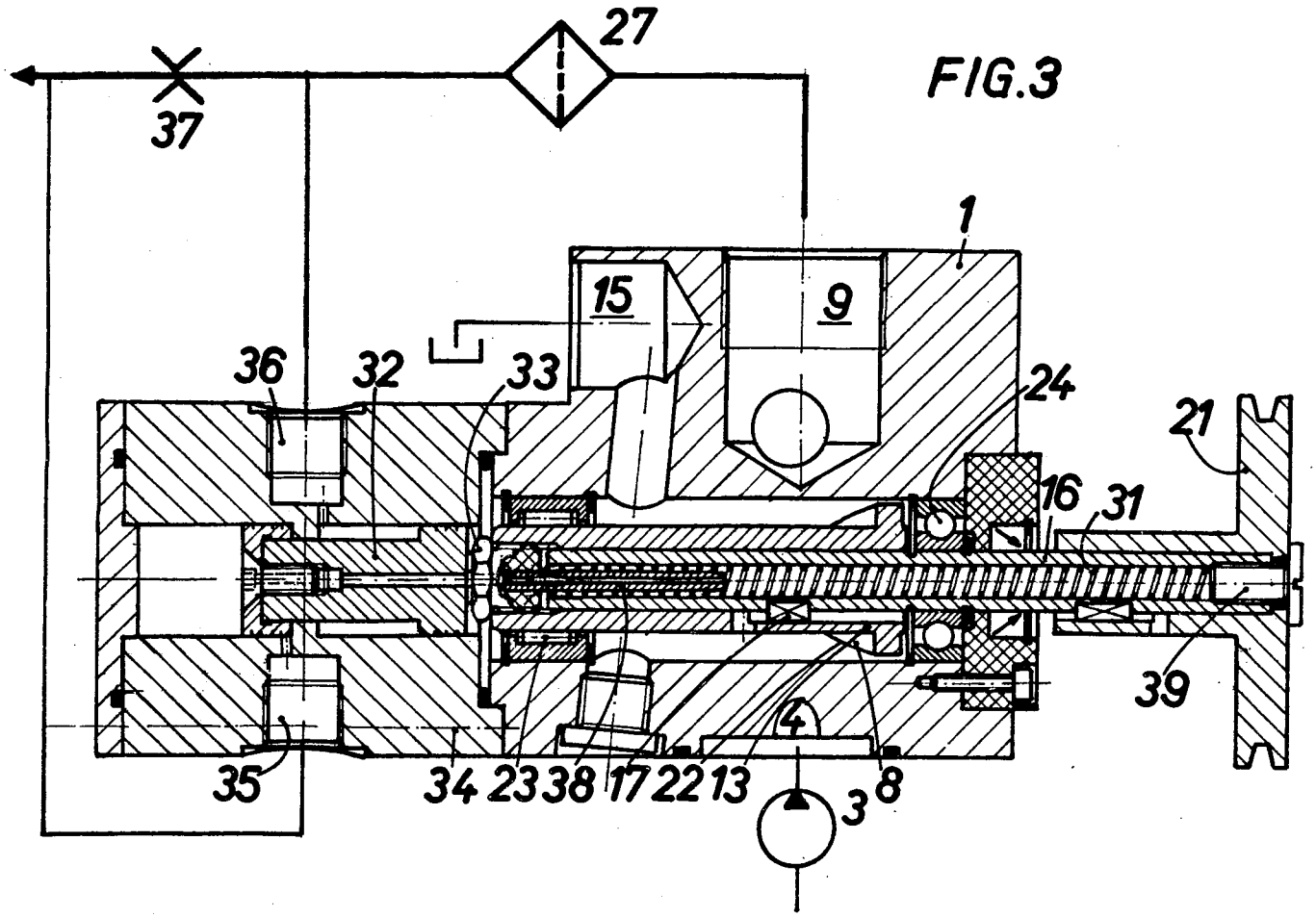
FIG. 3 is a cross-section through the axis of the drive shaft and the rotary shutter of the device according to the invention.

FIG. 3 is an axial section through the device according to the invention and corresponds substantially to that shown in the aforementioned U.S. Pat. No. 4,164,240. A positive displacement pump 3 is shown schematically to be coupled to the inlet 4 of the device. The inlet 4 communicates with two return flow nozzles (not visible in FIG. 3) which are disposed opposite one another (see FIG. 1) and also communicate with a consumer outlet 9 via respective spring-loaded check valves, best seen in FIGS. 1 and 2.

As already discussed and illustrated in FIGS. 1 and 2, the openings of the return flow nozzles are alternately opened and closed by a rotating shutter bushing 13 provided with shutter blades 8 and control edges 22. When the nozzle orifices are obturated by the shutter blades 8 the fluid is forced to flow to the consumer outlet line 9 through the check valves, whereas, when the orifices are open, the fluid returns without pressure to a reserve tank via the return flow nozzles and the line 15.

The rotary shutter bushing 13 is mounted on the drive shaft 16 in such a way as to permit limited axial movement and is forced to co-rotate therewith by a key 17. The drive shaft 16 may be provided with a pulley 21 driven, for example, via a belt by the gears of the associated pump. One end of the rotary shutter 13 is carried in a radial needle bearing 23, whereas the drive shaft 16 rotates in a radial ball bearing 24.

The axial position of the rotary shutter bushing 13, without play, is insured by the disposition of a spring 31 within the hollow bushing 13 which urges a glider 33 against an axial adjustment mechanism 32. The glider 33 is threadedly engaged within the rotary shutter bushing 13 and thus shares in its rotation while defining the axial location of the shutter 13 which thereby follows any axial motions of the non-rotating adjustment mechanism 32. In the embodiment illustrated, the adjustment mechanism is an equal surface piston disposed in a flow control system. One of the effective surfaces of the piston communicates with an inlet 35 disposed in a header 34 mounted on the valve housing 1 while the second surface of equal area communicates with a second inlet 36 therein. The two inlets 35, 36 communicate with opposite ends of a schematically shown measuring orifice 37 which is coupled with the consumer outlet 9 via a high-pressure filter 27.

It will thus be appreciated that the inlets 35 and 36 provide to the respective surfaces of the piston 32 the pressure drop across the measuring orifice 37. Accordingly, the adjustment piston 32 automatically assumes a position in which the force exerted by the spring 31 is balanced by the force due to the pressure drop across the measuring orifice 37. In this way, the illustrated apparatus causes a continuous variation of the axial position of the shutter bushing 13 so as to maintain a substantially constant pressure drop across the measuring orifice 37 and hence a constant fluid flow which depends in magnitude only on the size of the particular measuring orifice 37 which is employed.

A protective sleeve 38 within the hollow shutter bushing 13 encloses the end of the spring 31 and guides during long excursions. The basic pretension of the spring 31 can be adjusted by an externally accessible adjustment screw 39 disposed at the center of the drive shaft 16.

The axial adjustment mechanism described above may also be employed in a suitable control system for maintaining a given pressure in the output flow. Still further, the present invention may be provided with an axial adjustment mechanism which operates substantially as described in U.S. Pat. No. 4,164,240 and which is operated manually.

The spring-loaded axial positioning of the rotary shutter as described above retains the possibility of full axial adjustment while suppressing any undesirable motions due to the effects of pressure peaks occurring when the flows are switched and thus prevents an undesirable generation of noise with relatively simple means.

It is noted that various changes may be made without departing from the scope of the invention which is not to be considered limited to what is disclosed in the foregoing specification.

What is claimed is:

1. A flow control device for use in a system having an inlet line from a positive displacement fluid pump, a first outlet line directed to a load and a second outlet line directed to a zero pressure pump reservoir, comprising:

a fixed valve housing having a main bore therein, said bore communicating with the second outlet line;

two nozzles passing through said valve housing and extending into opposite sides of said bore, the openings of said nozzles being directed into said bore diametrically toward one another;

first conduit means in said valve housing for directing fluid from the inlet line to each of said nozzles;

rotary shutter means coaxially positioned within said bore for periodically and alternately, as said rotary shutter means continuously rotates, closing both of said nozzles, simultaneously, and opening said nozzles to allow flow into the second outlet line, whereby the necessity for a sealing relationship of said rotary shutter means with said valve housing is eliminated, said rotary shutter means comprising a drive shaft and two shutters thereon positioned to simultaneously close and open said nozzles, and including an axial bearing assembly for holding said shaft in coaxial alignment with said bore;

second conduit means for directing fluid from each of said first conduit means to the first outlet line; and check valve means permitting flow from the inlet line into the first outlet line only when said nozzles are closed, said check valve means including a valve seat having the shape of a protruding ring presenting an annular front surface, the inner and outer edges of said annular front surface being configured to meander about a circle in parallel relationship, thereby increasing the effective valve seat length and decreasing the effective valve seat width.

2. A flow control device according to claim 1, wherein said first conduit means terminates directly in bores in a nozzle block extending said nozzles and wherein said rings of said check valve seats are protruding from the ends of said bores remote from said rotary shutter means.

3. A flow control device according to claim 1, wherein said shutters of said rotary shutter means are positioned axially slidable on and keyed to said drive shaft held by said axial bearing assembly to allow axial as well as rotative movement of said shutters relative to and with said drive shaft, said shutters being urged by a spring disposed in said drive shaft against a non-rotating axially movable piston, said piston being actuated by a differential pressure upstream and downstream of a restriction positioned in the first outlet line directed to the load.

4. A flow control device for use in a system having an inlet line from a positive displacement fluid pump, a first outlet line directed to a load and a second outlet line directed to a zero pressure pump reservoir, comprising:

a fixed valve housing having a main bore therein, said bore communicating with the second outlet line;

two nozzles passing through said valve housing and extending into opposite sides of said bore, the openings of said nozzles being directed into said bore diametrically toward one another;

first conduit means in said valve housing for directing fluid from the inlet line to each of said nozzles;

rotary shutter means coaxially positioned within said bore for periodically and alternately, as said rotary shutter means continuously rotates, closing both of said nozzles, simultaneously, and opening said nozzles to allow flow into the second outlet line, whereby the necessity for a sealing relationship of said rotary shutter means with said valve housing is eliminated, said rotary shutter means comprising a drive shaft and two shutters thereon positioned to simultaneously close and open said nozzles, and including an axial bearing assembly for holding said shaft in coaxial alignment with said bore, wherein said shutters of said rotary shutter means are positioned axially slidable on and keyed to said drive shaft held by said axial bearing assembly to allow axial as well as rotative movement of said shutters relative to and with said drive shaft, said shutters being urged by a spring disposed in said drive shaft against a non-rotating axially movable piston, said piston being actuated by a differential pressure upstream and downstream of a restriction positioned in the first outlet line directed to the load;

second conduit means for directing fluid from each of said first conduit means to the first outlet line; and check valve means permitting flow from the inlet line into the first outlet line only when said nozzles are closed.

5. A flow control device according to claim 4, further comprising spring adjustment means disposed coaxially with said drive shaft on the end thereof opposite said axially mounted piston, said spring adjustment means being accessible from the exterior of said device.

6. A flow control device according to claim 4, wherein said shutters are provided with a rotary glide block facing said axially movable piston.

7. A flow control device for use in a system having an inlet line from a positive displacement fluid pump, a first outlet line directed to a load and a second outlet line directed to a zero pressure pump reservoir, comprising:

a fixed valve housing having a main bore therein, said bore communicating with the second outlet line;

two nozzles passing through said valve housing and extending into opposite sides of said bore, the openings of said nozzles being directed into said bore diametrically toward one another;

first conduit means in said valve housing for directing fluid from the inlet line to each of said nozzles;

rotary shutter means coaxially positioned within said bore for periodically and alternately, as said rotary shutter means continuously rotates, closing both of said nozzles, simultaneously, and opening said nozzles to allow flow into the second outlet line, whereby the necessity for a sealing relationship of said rotary shutter means with said valve housing is eliminated, said rotary shutter means comprising a drive shaft and two shutters thereon positioned to simultaneously close and open said nozzles, and including an axial bearing assembly for holding said shaft in coaxial alignment with said bore;

second conduit means for directing fluid from each of said first conduit means to the first outlet line; and two identical check valve means, each being disposed between one of said first conduit means and said second conduit means, for permitting flow from the inlet line into the first outlet line only when said nozzles are closed, for independent prevention of return flow through each of said second conduit means, and for maintaining substantially at a minimum the length of fluid columns between each of said check valves and said nozzle openings and said first conduit means, wherein each of said check valve means includes a valve seat having the shape of a protruding ring presenting an annular front surface, the inner and outer edges of said annular front surface being configured to meander about a circle in parallel relationship, thereby increasing the effective valve seat length and decreasing the effective valve seat width.

8. A flow control device according to claim 7, wherein said first conduit means terminate directly in bores in a nozzle block extending said nozzles and wherein said rings of said check valve seats are protruding from the ends of said bores remote from said rotary shutter means.

9. A flow control device according to claim 7, wherein said shutters of said rotary shutter means are positioned axially slidable on and keyed to said drive shaft held by said axial bearing assembly to allow axial as well as rotative movement of said shutters relative to and with said drive shaft, said shutters being urged by a spring disposed in said drive shaft against a non-rotating axially movable piston, said piston being actuated by a differential pressure upstream and downstream of a restriction positioned in the first outlet line directed to the load.

10. A flow control device for use in a system having an inlet line from a positive displacement fluid pump, a first outlet line directed to a load and a second outlet line directed to a zero pressure pump reservoir, comprising:

a fixed valve housing having a main bore therein, said bore communicating with the second outlet line;

two nozzles passing through said valve housing and extending into opposite sides of said bore, the openings of said nozzles being directed into said bore diametrically toward one another;

first conduit means in said valve housing for directing fluid from the inlet line to each of said nozzles;

rotary shutter means coaxially positioned within said bore for periodically and alternately, as said rotary shutter means continuously rotates, closing both of said nozzles, simultaneously, and opening said nozzles to allow flow into the second outlet line, whereby the necessity for a sealing relationship of said rotary shutter means with said valve housing is eliminated, said rotary shutter means comprising a drive shaft and two shutters thereon positioned to simultaneously close and open said nozzles, and including an axial bearing assembly for holding said shaft in coaxial alignment with said bore, wherein said shutters of said rotary shutter means are positioned axially slidable on and keyed to said drive shaft held by said axial bearing assembly to allow axial as well as rotative movement of said shutters relative to and with said drive shaft, said shutter being urged by a spring disposed in said drive shaft against a non-rotating axially movable piston 32, said piston being actuated by a differential pressure upstream and downstream of a restriction positioned in the first outlet line directed to the load;

second conduit means for directing fluid from each of said first conduit means to the first outlet line; and two identical check valve means, each being disposed between one of said first conduit means and said second conduit means, for permitting flow from the inlet line into the first outlet line only when said nozzles are closed, for independent prevention of return flow through each of said second conduit means, and for maintaining substantially at a minimum the length of fluid columns between each of said check valves and said nozzle openings and said first conduit means.

11. A flow control device according to claim 10, further comprising spring adjustment means disposed coaxially with said drive shaft on the end thereof opposite said axially movable piston, said spring adjustment means being accessible from the exterior of said device.

12. A flow control device according to claim 10, wherein said shutters are provided with a rotary glide block facing said axially movable piston.

13. A flow control device for use in a system having an inlet line from a positive displacement fluid pump, a first outlet line directed to a load and a second outlet line directed to a zero pressure pump reservoir, comprising:

a fixed valve housing having a main bore therein, said bore communicating with the second outlet line;

two nozzles passing through said valve housing and extending into opposite sides of said bore, the openings of said nozzles being directed into said bore diametrically toward one another;

first conduit means in said valve housing for directing fluid from the inlet line to each of said nozzles;

rotary shutter means coaxially positioned within said bore for periodically and alternately, as said rotary shutter means continuously rotates, closing both of said nozzles, simultaneously, and opening said nozzles to allow flow into the second outlet line, whereby the necessity for a sealing relationship of said rotary shutter means with said valve housing is eliminated, said rotary shutter means comprising a drive shaft and two shutters thereon positioned to simultaneously close and open said nozzles, and including an axial bearing assembly for holding said shaft in coaxial alignment with said bore;

second conduit means for directing fluid from each of said first conduit means to the first outlet line;

two identical check valve means, each being disposed between one of said first conduit means and said second conduit means, for permitting flow from the inlet line into the first outlet line only when said nozzles are closed, for independent prevention of return flow through each of said second conduit means, and for maintaining substantially at a minimum the length of fluid columns between each of said check valves and said nozzle openings and said first conduit means;

two nozzle blocks, each of said nozzle blocks being disposed on said valve housing and having a chamber section with a chamber therein and a nozzle section depending from said chamber section and passing through said valve housing, said nozzle section having one of said nozzles at one end thereof, said nozzle connecting to a nozzle bore extending axially from said nozzle into said chamber, each of said first conduits terminating in a respective one of said nozzle bores, wherein one of said second conduit means is disposed at least partially in each said nozzle block, communicating with the chamber thereof, and one of said check valve means is disposed in the chamber of each said nozzle block, the terminus of each said nozzle bore serving as the valve seat for each said check valve means; and a demountable cap connected to each of said nozzle blocks, and closing the chamber thereof,for defining the operating position of each said check valve means.

* * * * *